United States Patent [19]

Bagnall

[11] Patent Number: 4,815,401

[45] Date of Patent: Mar. 28, 1989

[54] TUFTING MACHINE INDEXING DRIVE APPARATUS

[75] Inventor: Arthur F. Bagnall, Whitefield, England

[73] Assignee: Spencer Wright Industries, Inc., Dalton, Ga.

[21] Appl. No.: 186,357

[22] Filed: Apr. 26, 1988

[30] Foreign Application Priority Data

May 15, 1987 [GB] United Kingdom ..... 8711519

[51] Int. Cl.[4] ..... D05C 15/30

[52] U.S. Cl. ..... 112/80.41

[58] Field of Search ..... 112/80.41, 80.4, 80.32

[56] References Cited

U.S. PATENT DOCUMENTS 4,557,208 12/1985 Ingram et al. ..... 112/80.32

4,653,413 3/1987 Bagnall ..... 112/80.41

*Primary Examiner*—Ronald Feldbaum

*Attorney, Agent, or Firm*—Alan Ruderman

[57] ABSTRACT

An indexing mechanism for a tufting machine for indexing a needle bar or a backing material feed roller has three oscillating input gear sectors, a drive transmission corresponding to each gear sector, an output member and a programmable selector mechanism for each drive transmission for periodically selectively coupling the corresponding drive transmission with the respective gear sector. The drive transmissions include a pair of epicyclic gear assemblies having planet gears mounted within a common planet cage. The sun gear of one of the assemblies is connected to a flywheel coupled to a transfer gear which may be selectively moved to receive motion from a first sector. The ring gear of one epicyclic gear assembly is coupled to a second transfer gear which may be selectively moved to receive motion from a second gear sector. The other epicyclic gear assembly has its ring gear coupled to a third transfer gear which may be selectively moved to receive motion from the third gear sector. The output member is connected to the sun gear of the section epicyclic gear assembly and is thus indexed in accordance with the cumulative inputs. The selector mechanism for each transmission includes a continuous chain having rollers disposed thereon in accordance with a pattern, the rollers acting to engage a lever attached to articulating linkage. The articulating linkage is biased to an overcenter position and is cyclically driven to move the respective transfer gear into mesh with the corresponding gear sector unless a roller engages the lever and collapses the linkage.

22 Claims, 4 Drawing Sheets

TUFTING MACHINE INDEXING DRIVE APPARATUS

BACKGROUND OF THE INVENTION

This invention relates to tufting machines and more particularly to indexing apparatus for laterally shifting the needle bar or for feeding the backing material in a selectively controlled stepwise manner so as to provide a patterning effect in the tufted fabric produced thereby to extend the patterning capabilities of the tufting machine.

In the production of tufted fabric it is known to jog or shift the needle bar in its longitudinal direction tranversely across the tufting machine relatively to the base material in order to create various pattern effects, to break up the unattractive alignment of the longitudinal rows of tufts and to reduce the affects of streaking which results from variations and colorations of the yarn.

Various devices have been proposed and are in use for controllably applying a step-wise force to the needle bar of the tufting machine in accordance with a pattern. Such needle shifting or stitch placement drives conventionally fall into two categories. The first category is that of the cam driven type whereby a rotating plate cam, driven in timed relationship with the tufting machine mainshaft, is drivingly engaged with the needle bar so as to effect the required displacement thereof. The second category is that of the programmable type which may be hydraulically or pneumatically driven, or driven mechanically through some form of programmable indexing device whereby a ram is drivingly engaged with the needle bar so as to effect the required displacement thereof. Examples of such drives are illustrated in U.S. Pat. Nos. 3,964,408 and 3,972,295, which utilize pawl and ratchet devices, U.S. Pat. No. 4,010,700 which utilizes an indexing device and 4,173,192 which uses a hydraulic actuator. In U.S. Pat. No. 4,392,440, an indexing device is proposed for extending the pattern capabilities of a cam by means of a device which intermittently drives the cam. In U.S. Pat. No. 4,653,413 an epicyclic drive effectively extends the range of the cam systems by driving the cam with an oscillating motion superimposed onto a constant speed input to provide a cyclically variable input to drive the cam, and by varying the amplitude of oscillation, a single cam may provide a multiplicity of patterns.

In U.S. Pat. No. 4,557,208 a backing material feed drive system is proposed including an indexing drive device for driving the feed rollers in a controllably varying manner.

In certain applications it is desirable to, for example, laterally step the needle bar selectively in one, two, or three steps during a particular machine cycle. This is highly desirable when utilizing two sliding needle bars which can be shifted independently so as to provide unique patterning effects. In the prior art devices such patterning effects have been provided either by computer controlled hydraulic actuators or by separate and independent cam drives. Although the cam drive system is exceptionally reliable it has a disadvantage of not being programmable and wherever the pattern is changed, the cams must be changed. The hydraulically actuated drive, and pneumatically actuated drives, are electronically programmable, but the skills in programming the electronics are not readily available in most carpet mills, where such apparatus operates. Accordingly, either a substantial number of cams or electronic chips must be inventoried in the mill, or when a new pattern is required, such cams must be designed and manufactured or such chips must be programmed at locations other than at the mill, thereby necessitating the inherent delays.

Ideally a mechanically programmable drive system which is highly accurate and which can provide a multiplicity of gauge movements to the needle bar is highly desirable. Such a system could overcome the need to inventory cams or electronic chips and be within the capabilities of the tufting machine mill operators to program selectively as required. Although extensive work has been directed in this area, the prior art has not developed such a system.

SUMMARY OF THE INVENTION

Consequently, it is a primary object of the present invention to provide indexing apparatus for a tufting machine which may be mechanically programmed to provide accurate and controlled displacement of a tufting machine needle bar or a tufting machine backing material drive roller.

It is another object of the present invention to provide indexing drive apparatus for a tufting machine, the apparatus comprising at least three inputs which may be independently selectively coupled to a single output by means of transmissions corresponding to each input and coupled to the output, the inputs being collectively applied to the output to provide a summation of the inputs at the output, and means for selectively coupling each of the inputs independently to the output in accordance with a program.

It is a further object of the present invention to provide in a tufting machine, indexing drive apparatus having a plurality of drive inputs and a drive output, a selectively engagable drive transmission corresponding to each drive input coupled to the drive output, and a mechanically programmable selection apparatus for each drive transmission to selectively bring the respective drive transmission into driving engagement with the corresponding drive input to drive the respective drive transmission and thereby collectively apply the drive inputs to the drive output.

It is a still further object of the present invention to provide a tufting machine with indexing apparatus including a plurality of controlled rotary inputs collectively applied to a single output shaft selectively, each input being selectively coupled to a respective transmission coupled to a mechanical adder having its output connected to the output shaft, and programmable selection means for selectively coupling each transmission independently to the respective input to drive the output shaft by the composite of the inputs.

It is a yet further object of the present invention to provide indexing apparatus for a tufting machine, the apparatus having plural inputs and a single output, the output being the summation of the inputs, the inputs being selectively applied to the apparatus by selection means corresponding to each input, the selection means being mechanically programmed to either or not transmit motion from a respective input to the output.

It a yet still further object of the present invention to provide a tufting machine with indexing apparatus including a plurality of controlled rotary inputs and a single output, the inputs being selectively and independently coupled to the sun gear of a first epicyclic gear assembly, the ring gear of the first epicyclic gear assembly and the ring gear of a second epicyclic gear assembly having a common planet gear cage with the first assembly, and the sun gear of the second assembly being connected to the output, and mechanically programmable selection means for selectively coupling each input to the gearing.

It is a still yet further object of the present invention to provide indexing apparatus for a tufting machine for indexing the needle bar or backing material feed rollers in selective increments, the selection being a mechanically programmable selection means including a driven continuous chain having rollers selectively positioned thereon, the presence or absence of the rollers being sensed by linkage to transmit a cyclical force to the input of the indexing apparatus, the rollers acting to control whether or not the linkage transmits the force during any particular cycle.

It is a further object yet to provide a tufting machine with indexing apparatus including a plurality of controlled rotating inputs and a single output, the inputs being selectively and independently coupled to the sun gear of a first epicyclic gear assembly, the ring gear of the first epicyclic gear assembly and the ring gear of a second epicyclic gear assembly, the second assembly having a common planet gear cage with the first assembly, the sun gear of the second assembly being connected to the output, and mechanically programmable selection means including a driven continuous chain corresponding to each input, the chains having rollers selectively positioned thereon, the presence or absence of the rollers being sensed by linkage to transmit or not transmit a cyclical force to the respective input during any particular cycle.

Accordingly, the present invention provides an indexing mechanism for a tufting machine, the mechanism comprising a plurality of drive input means, a drive output means, a selectively engagable drive transmission means corresponding to each drive input means disposed intermediate a respective drive input means and the drive output means, and programmable selection means for each drive transmission means for periodically selectively coupling the corresponding drive transmission means with the respective drive input means to provide a controlled rotary input to the respective drive transmission means periodically, the controlled inputs to the drive transmissions being collectively applied by the drive transmissions to the drive output means, so that the drive output means is the sum of the selected inputs.

In the preferred form of the invention there are three inputs for providing three discrete index steps in each of two directions. Each drive input means comprises a drive member oscillating about a pivot in timed relationship with the tufting machine. The drive member may be coupled to the respective drive transmission to transfer motion thereto in either direction. The respective selection means determines when the motion is to be transmitted in either direction of the oscillating cycle and effects movement of the corresponding drive transmission for coupling engagement with the drive member. The drive transmissions have associated therewith a pair of oppositely disposed epicyclic gear assemblies having planet gears mounted within a common planet cage or spider. The sun gear of one of the epicyclic gear assemblies is operatively connected to transfer means of one of the drive transmissions and has its annulus or ring gear connected to transfer means of a second of the drive transmissions. The other epicyclic gear assembly has its annulus or ring gear connected to transfer means of the third drive transmission while the output means is connected to the sun gear thereof. Thus, when motion is transmitted in either direction to a drive transmission from a respective input means, this motion together with the motion which may be transmitted to the other drive transmissions is collectively applied to the output means through the epicyclic gearing associated with the three transmissions. The gear ratios of the epicyclic gearing may be selected such that three discrete indexing steps in either direction may be obtained at the output.

The drive member of each drive input means preferably is a gear section or sector and the corresponding drive transmission has a transfer gear operatively coupled to the associated epicyclic gear assembly and adapted to be moved into meshing engagement with the respective gear sector. The transfer gears are mounted in respective carriages and together therewith may be rocked about a pivot shaft into and out of such meshing relationship individually, while remaining in coupled relationship with the epicyclic gearing.

The selection means includes means for selecting when a transfer gear is to be rocked into driving relationship with the associated gear sector, such selection means preferably comprising a mechanically programmed apparatus wherein the program may be changed merely by varying the position of certain mechanical elements, thereby making program changes readily available to those lacking electronic skills while having conventional skills in the art. Preferably each selection means includes a continuous pattern chain driven in timed relationship with the tufting machine, the chain having repositionable contacts in the form of rollers, the position of the rollers determining whether o not the corresponding input means is to be transmitted to the respective drive transmission. The selection means include cyclically driven actuator means which receives program signals as determined by the presence or absence of a roller and transmits these signals to the respective drive transmissions.

In the preferred form of the invention the cyclically driven actuator means includes a pivotably mounted rocking lever connected to articulating linkage through which the rocking movement of the lever is transmitted or not transmitted as determined by the rollers. The articulating linkage is spring loaded to an overcenter position unless the linkage is collapsed by displacement from its overcenter position, such displacement being effected by the presence of a roller acting on the linkage to overcome the bias of the spring. The linkage is operatively connected to a respective transfer gear carriage and when the articulating linkage is overcenter, the actuator means forces the carriage to pivot so that the respective transfer gear engages the corresponding gear sector to receive its input, but if the linkage is collapsed, no force is applied to the carriage and it is biased to a position where its associated transfer gear receives no input motion.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
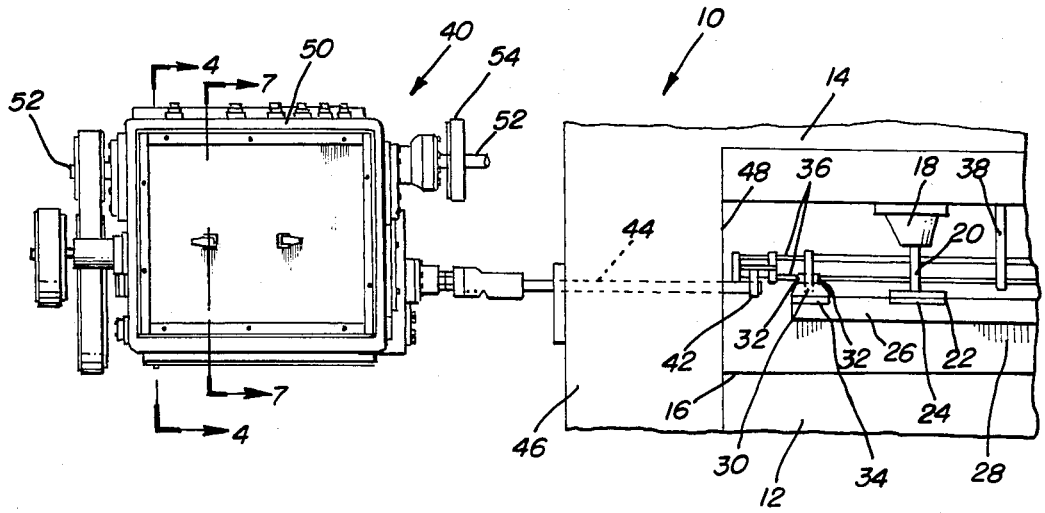
FIG. 1 is a fragmentary front elevational view of a tufting machine incorporating indexing apparatus constructed in accordance with the principles of the present invention, the apparatus being applied to shift the tufting machine needle bar.
Figure 3:
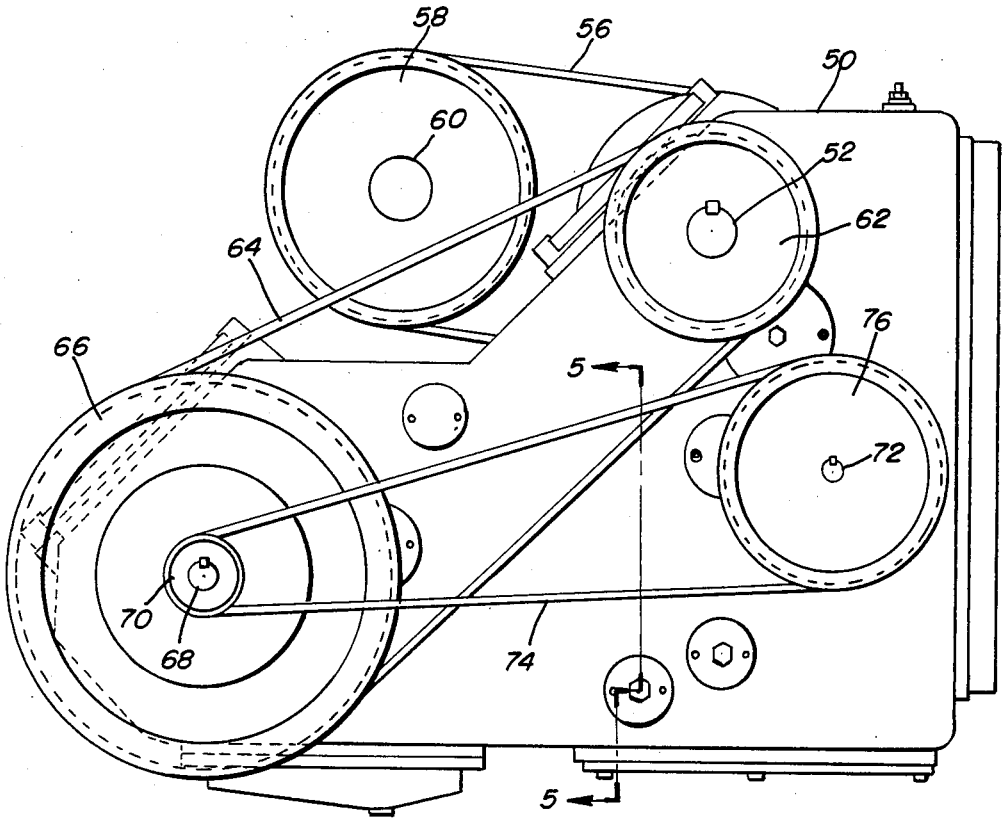
FIG. 3 is an end elevational view of the indexing apparatus illustrated in FIG. 1.

Referring now to the drawings, FIG. 1 illustrates a general arrangement of a tufting machine 10 having a frame comprising a bed 12 and a head 14 disposed above the bed. The bed includes a needle plate 16 over which backing material 15 is adapted to be fed by conventional feed rollers, illustrated diagrammatically at 17.

Mounted in the head 14 for vertical reciprocation within one of a plurality of bushing assemblies 18 is a respective push rod 20 to the lower end of which a needle bar support foot 22 is carried. The support foot 22 has a slideway within which a slide plate 24 is slidably received A needle bar 26 is secured to the plate 24 and is slidable laterally relative to the slideway and reciprocably driven vertically by the action of the push rod. The needle bar 26 carries a plurality of needles 28 adapted to penetrate the base material upon reciprocation of the needle bar to project loops of yarn therethrough as the push rods are reciprocated by conventional means. The needles conventionally cooperate with loopers (not illustrated) mounted beneath the needle plate for seizing the loops of yarn presented by the needles and for releasing the loops to form loop pile or for holding the loops until cut by a knife cooperating with the loopers or hooks as is notoriously well known in the tufting art.

In order to drive the needle bar 26 selectively with controlled lateral movement, the needle bar may be provided with a number of upstanding plate members 30 which are straddled by a pair of rollers 32 pivotably mounted on mounting plates 34 secured to brackets (not illustrated) clamped to a pair of laterally extending slide rods 36. The slide rods are journalled in brackets 38 fixed to the head 14 of the machine above the needle bar. At one end of the machine the slide rods 36 are fastened to a clamping block 42 above the bed. A drive rod 44 is secured to the clamping block 42 and extends through the end housing 46 of the tufting machine toward needle bar shifting apparatus 40 ,and journalled in the wall 48 for lateral movement. For patterning purposes the tufting machine may include two needle bars mounted one behind and adjacent to each other. In such case each needle bar may be laterally shifted independently by having a separate shifting apparatus 40 connected as above indicated to opposite ends of each respective needle bar.

In accordance with the present invention the shifting apparatus 40 comprises mechanically programmable indexing apparatus constructed in accordance with the principles of the present invention. Accordingly, the apparatus 40 comprises a housing 50 within which a shaft 52 is journally mounted. A pulley 54 is carried on the shaft 52 externally of the housing and is driven by a belt 56 trained about another pulley 58 mounted on an extension of the mainshaft 60 of the tufting machine mounted in the head 14 thereof. On the opposite end of the housing 50 from the pulley 54 the shaft 52 carries another pulley 62 about which a belt 64 is trained and rotatably drives another pulley 66 carried on a cam shaft 68 journalled in the housing for purposes hereinafter to be described. Another pulley 70 mounted on the shaft 68 drives a sprocket drive shaft 72 journalled in the housing for purposes hereinafter to be described by means of a belt 74 trained about the pulley 70 and a pulley 76 mounted externally of the shaft 72.

Figure 4:
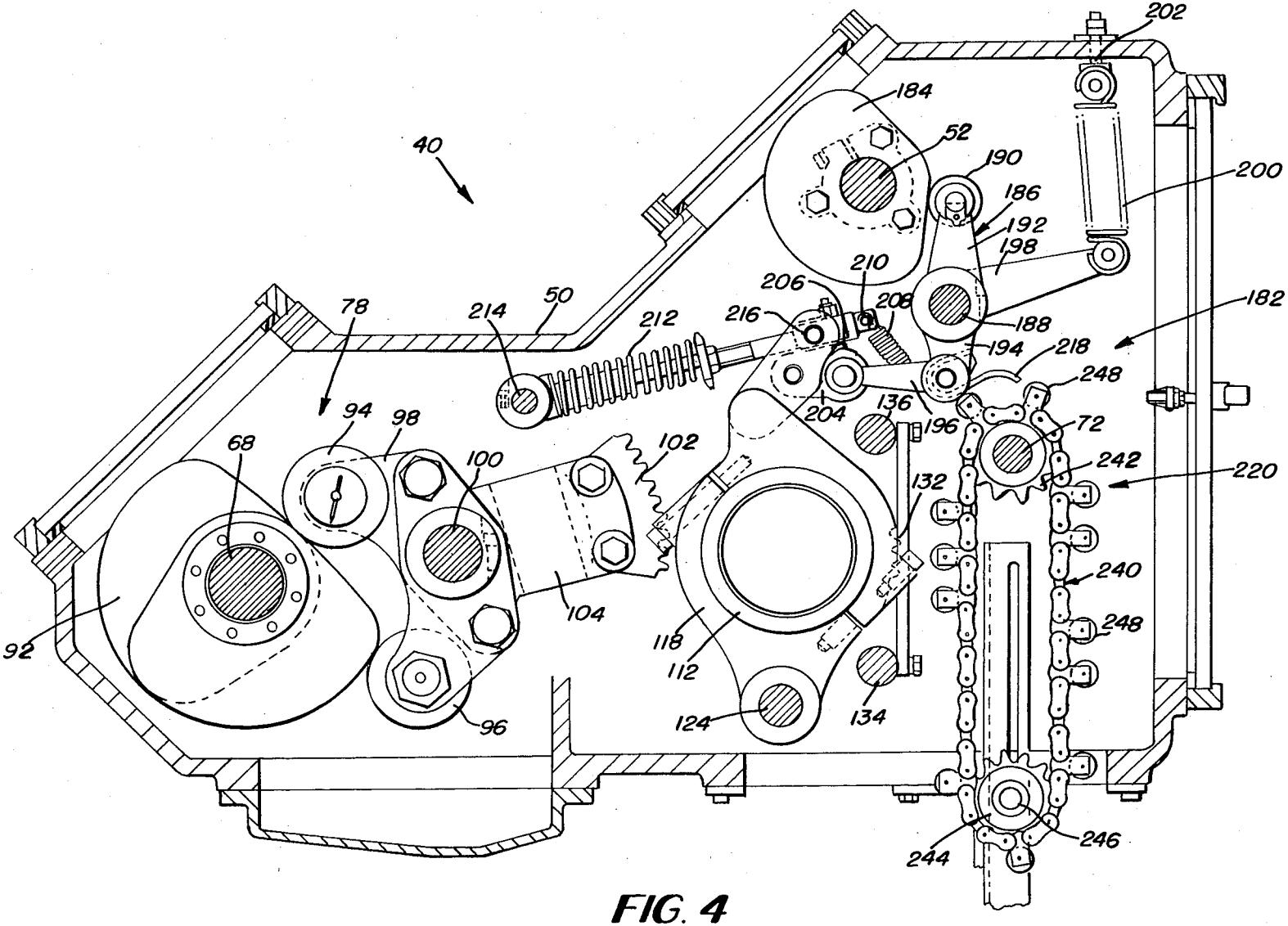
FIG. 4 is a cross sectional view taken substantially along line 4—4 of FIG. 3.

In the preferred form of the invention the indexing mechanism has three input drive means, only one of which is illustrated since they are substantially identical, and is generally indicated in FIG. 4 at 78. Each of the input drive means is selectively coupled to a respective drive transmission 80, 82, 84 illustrated in FIG. 5, each transmission being coupled, as hereinafter described, with an associated pair of oppositely disposed epicyclic gear assemblies generally indicated at 86, 88, the output of which is supplied to an output shaft 90 for driving the rod 44.

Referring to FIG. 4, each input drive means 78 comprises a conjugate cam 92 fastened on the cam shaft 68, the cams 92 being spaced apart through the housing 50. Each cam 92 cooperates with a pair of cam followers 94, 96 carried on a saddle shaped rocking lever 98 pivotably mounted on a fixed shaft 100, the lever 98 preferably as illustrated comprising two half saddle members connected together and the followers 94, 96 being carried at the extremities thereof and disposed in contact with the respective cam. Each cam 92 has a configuration which provides an oscillating motion to the lever 98 about the shaft 100 and a dwell at the end of each movement thereof. A gear sector 102 is attached to an arm 104 carried by each saddle lever 98 so as to rock first in one direction and then in the opposite direction after each dwell. In the preferred embodiment, the shaft 68 is driven at half the speed of the tufting machine so that each gear sector 102 rocks in one direction during each machine cycle and in the opposite direction during the subsequent machine cycle, the dwell occurring during that portion of the machine cycle while the needles are within the backing material.

Each drive transmission 80, 82, 84, includes a respective transfer gear 106, 108, 110 having external teeth adapted for meshing with a respective one of the three gear sectors 102 and journally mounted on a respective sleeve 112, 114, 116. The sleeves 112, 114, 116 are fixedly carried within a respective gear carriage 118, 120, 122 which is clamped about an end of the sleeve adjacent the respective transfer gear, the carriage being pivotably journalled at one respective end on a fixed shaft 124 extending through the housing 50 substantially parallel to the shaft 110, and the carriages being spaced apart in a manner similar to the conjugate cams 92 and the gear sectors 102. The other end of each gear carriage remote from the shaft 124 comprises a respective bifurcated link 126, 128, 130 for receiving linkage of respective actuating means as hereinafter described for selectively rocking the respective carriage about the shaft 124 to engage the associated transfer gear 106, 108, 110 with the corresponding gear sector 102 and thus impart the motion of the gear sector to the transfer gear. When each carriage is not so rocked it is biased away from its corresponding gear sector and rests or is parked in a respective rock 132 fastened to rods 134, 136 fastened in the housing 50 on the side of the centerline of the gears remote from the sector.

The epicyclic gear assemblies 86, 88 comprise respective annular or internal tooth ring gears 138, 140, the respective housings thereof having oppositely extending hub portions 142, 144 and having their respective open annulus facing one another. The hub portion 142 of the ring gear 138 is rotatably journalled on an input shaft 146 while the hub portion 144 of the ring gear 140 is rotatably journalled on the output shaft 90 which is axially aligned with the shaft 146. The sun gear 148 of the epicyclic gear assembly 86 is fixedly mounted on the input shaft 146, and the sun gear 150 of the epicyclic gear assembly 88 is fixedly mounted on the output shaft 90. The epicyclic gear assemblies 86, 88 share a common planet cage or spider 152 rotatably mounted in a rib 154 fixed to the housing 50, the spider carrying the planet pins 156 on which the planet gears 158, 160 of the respective assembly 86, 88 are rotatably mounted.

The input shaft 146 is rotatably journalled at one end adjacent the sun gear 148 in the spider 152 and in a rib 162 fixed to the housing 50 adjacent its other end, while the output shaft 90 is rotatably journalled at one end adjacent the sun gear 150 in the spider 152 and in an annular cage 164 fixed in another rib 166 which in turn is fixed to the housing 50 adjacent its outer end. A ring or flywheel 168 is secured to the end of the input shaft 146 remote from the sun gear 148 and is coupled to the transfer gear 106 by means of an Oldham coupling 170 which is a sliding coupling that permits the flywheel 168 and gear 106 to remain coupled when the transfer gear 106 is rocked with its carriage about the pivot shaft 124. Similar Oldham couplings 172, 174 couple the transfer gear 108 with the ring gear 138 of the epicyclic gear assembly 86 and the transfer gear 110 with the ring gear 140 of the epicyclic gear assembly 88. The output end of the output shaft 90 is splined as indicated at 176 and transmits the rocking or oscillating rotational motion of the output shaft 90 to a coaxial lead screw 178 which converts this motion into a linear motion which is applied by connecting means 180 to the drive rod 44 to shift or index the needle bar. It is to be understood, however, that in the event that the indexing requirement is rotational, such as for driving the backing material feed roller, such motion may be taken from the output shaft 90 without conversion to linear motion.

Figures 2, 5:
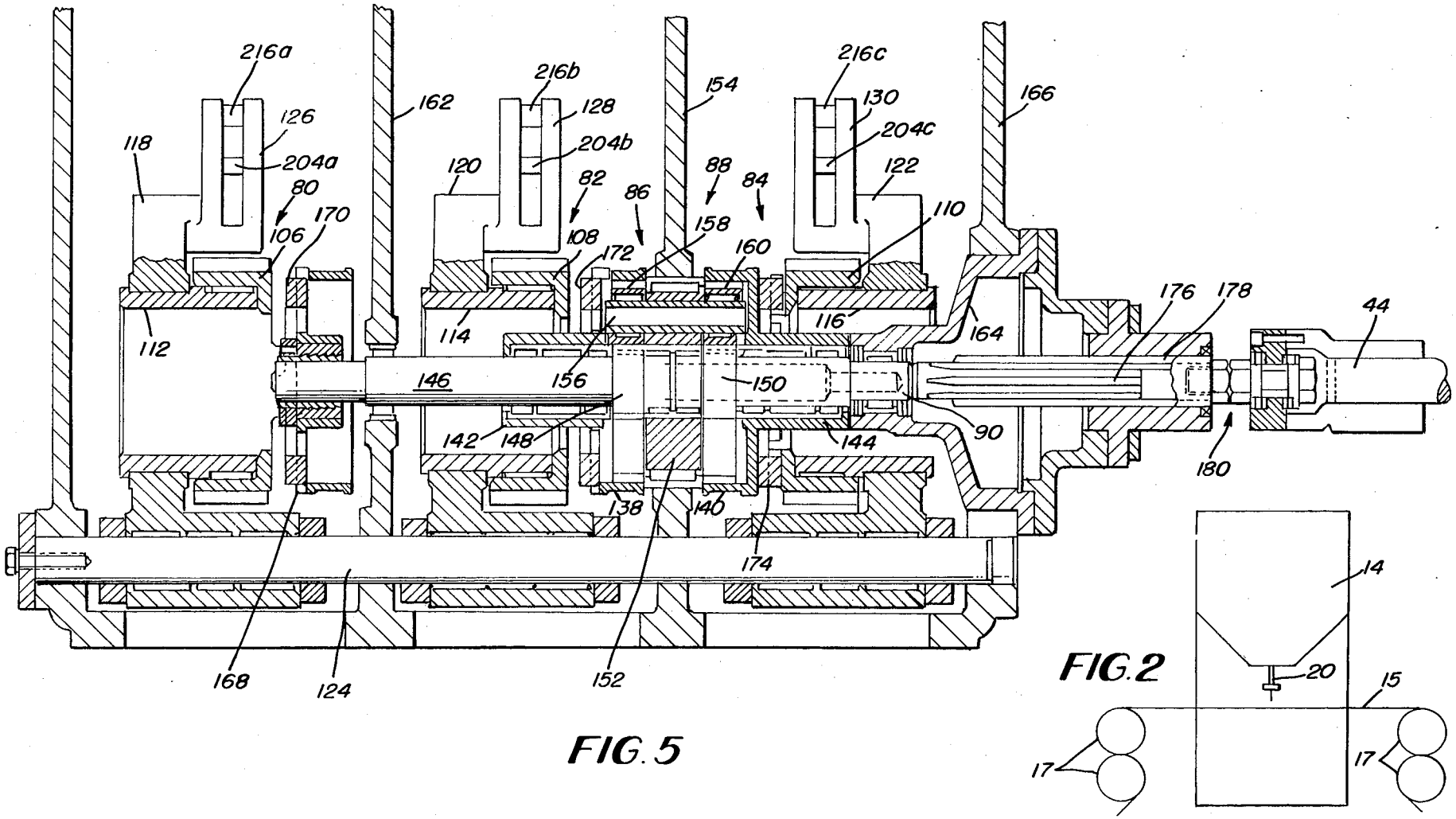
FIG. 2 is an end elevational view of the tufting machine.
FIG. 5 is a cross sectional view taken substantially along line 5—5 of FIG. 3.
Figure 6:
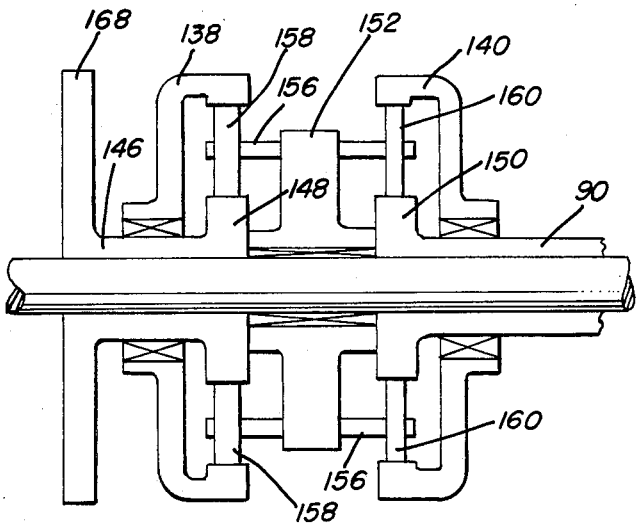
FIG. 6 is a diagrammatic view illustrating the principles of the epicyclic gearing associated with the drive transmissions of the indexing apparatus of the present invention.

The operation of the mechanism thus far described may be understood with reference to FIGS. 4, 5 and 6. The rotary input motion from the cam shaft 68 causes the gear sectors 102 to oscillate first in one direction and dwell and then in the other direction and dwell. Such oscillatory motion of the gear sectors is transmitted to the flywheel 168 and to the ring gears 138, 140 according to the position of the respective gear carriages 118, 120, 122 as determined by the pattern controlled selection means, generally indicated at FIG. 4 at 182, and which will hereinafter be described in detail. The meshing egagement of the respective gear sector and transfer gear sector and transfer gear occurs during the dwell, and the transfer gear then is turned when the sector again moves. When the gear carriage 118 is pivoted about the shaft 124 the motion from the gear sector is transmitted to the transfer gear 106 and by means of the Oldham coupling 170 to the flywheel 168. This imparts a rotation in the same direction to the sun gear 148, and if the gear carriages 120, 122 have not been moved to engage their associated transfer gear 108, 110 respectively, the sun gear 148 will rotate the spider 152 in the same direction and result in a rotation of the sun gear 150 in that same direction. A single increment of movement of the gear sector 102 associated with the flywheel 168 will thus result in a single increment of movement to the sun gear 150 and thus the output shaft 90. The direction of rotation is dependent upon the direction in which the gear sector 102 is moving.

If, however, the carriage 120 is pivoted about the shaft 124 to engage the transfer gear 108 associated with the ring gear 138, but the other carriages 118, 122 are not so pivoted, its associated gear sector 102 will effect rotation of the ring gear 138 again dependent upon the direction in which the gear sector is moving, and the ring gear will turn the spider 152 in the same direction in which it turns. This effects a turning of the sun gear 150 and the output shaft 90 in that same direction. A rotation of the ring gear 140 in a given direction by pivoting the carriage 122 to engage the transfer gear 110 with its associated gear sector 102, while not pivoting the carriages 118 and 120, will turn the planet gears 160 in that same direction but turn the sun gear 150 and the output shaft 90 in the opposite direction.

Any one or more of the gear carriages 118, 120, 122 may be pivoted about the shaft 124 to apply the input motions from the respective gear sectors 102 collectively to the epicyclic gearing assemblies and result in a summation of the collective inputs at the output shaft 90. Thus, since a clockwise turn to the flywheel 168 rotates the output shaft 90 clockwise, and a clockwise turn on the ring gear 138 rotates the output shaft 90 clockwise, but a clockwise turn on the ring gear 140 turns the output shaft 90 in a counter-clockwise direction, application of inputs to the flywheel 168, the ring gear 138 and the ring gear 140 in various combinations will, according to the gear ratios of the epicyclic gear assemblies, provide a range of possible rotational increments at the output shaft 90. Therefore, selection of the gear ratios of the epicyclic gear assemblies and the pitch of the lead screw 178, may provide single, double and triple gauge linear moves to the drive rod 44 to shift the needle bar laterally one, two, and three gauge steps selectively. For example, if the ratios are selected such that one movement of the gear sector associated with the flywheel 168 effects a single gauge step of the drive rod 44, and one movement of the gear sector associated with the ring gear 138 effects a two gauge movement of the drive rod 44, a single step in a first direction can be obtained merely by selectively pivoting the gear carriage 118, a double step may occur by solely pivoting the gear carriage 120 associated with the ring gear 138, and a triple gauge move in that same direction may be obtained by pivoting both gear carriages 118 and 120 to drive the flywheel 168 and the ring gear 138.

If however, a shift in the opposite direction is desired, solely pivoting the gear carriage 122 associated with the ring gear 140 may provide a triple gauge move in that opposite direction, while a double gauge move in that direction can be obtained by pivoting the carriages 122 and 118 to respectively drive the ring gear 140 and the flywheel 168, the single step provided by the carriage 118 in the first direction being subtracted from the triple step provided by the carriage 122 in the opposite direction. In a similar manner if a single step shift is desired in that opposite direction the carriages 120 and 122 may be pivoted so that the ring gears 138 and 140 are both driven, and since their outputs are in an opposite sense, single step shift will occur in the direction opposite to the direction such shift would occur if applied through the medium of the flywheel 168 solely. Thus, a lateral shift in one direction or a lateral shift in the opposite direction may be obtained in single, double or triple gauge steps selectively as determined by the selection means 182. It should be appreciated, however, that an increased range of increments is possible by varying the gear ratios of the epicyclic gear assemblies or by introducing further epicyclic assemblies.

The selection means 182, as illustrated in FIG. 4, includes cyclicly driven actuator means comprising a rotary cam 184 mounted on the shaft 52 for each carriage 118, 120, 122, which effects pivotal motion of a respective three arm lever 186 supported on a fixed shaft 188 mounted in the housing 50. The lever 186 effectively is a bell crank lever having a cam follower 190 carried at the end of one arm 192, a second arm 194 pivotably connected to a link 196, and the third arm 198 is connected to one end of a coil spring 200 so that operative movement of the lever 186 about the shaft 188 is against the restraint imposed by the spring 200, the opposite end thereof being secured to a bolt 202 carried by the housing 50. The shaft 52 is rotatably driven in timed relationship with the tufting machine cycle and the shape of the cams 184 are such that the lever 186 is pivoted about the shaft 188 against the restraint of the spring 200 during the major portion of each cycle and pivotably oscillates in the opposite direction during a smaller portion thereof. The link 196 together with a second link 204 which is connected to the end of the link 196 remote from the latter's connection with the lever arm 194 form an articulated linkage, the end of the link 204 remote from its connection with the link 196 being connected to a respective one of the gear carriages 118, 120, 122 within the respective bifurcated link portion 126, 128, 130 such as illustrated in FIG. 5 at the references 204*a*, 204*b*, and 204*c*.

The articulated linkage comprising the links 196 and 204 for each gear carriage is spring-loaded to an overcenter or extended position against a stop 206 by means of a spring 208 connected to and acting between the link 196 and a stud 210. When disposed in the extended or overcenter position the articulated linkage displaces the respective gear carriage 118, 120, 122 to a drive position in which the respective transfer gear 106, 108, 110 is engaged with the corresponding gear sector 102 upon rotation of the cam 84, such action being against the resistence of a return spring 212 connected at one end to a fixed stud 214 and at the other end to a block 216 carried between the respective bifurcated link 126, 128, 130 of the corresponding gear carriage 118, 120, 122, the blocks being indicated at 216*a*, 216*b*, 216*c*, in FIG. 5. Preferably the blocks 216 carry the respective stud 210 of the springs 208. The return spring 212 has a substantially greater restraint than the spring 208 and urges the respective gear carriage 118, 120, 122 toward the fixed parking rack 132. Thus, if a particular gear carriage is required to remain in its parked position, i.e., not to be rotated about the shaft 124, the drive linkage between the lever 186 and the corresponding gear carriage is interupted by a break-down or collapse resulting from relative articulation between the links 196 and 204 of the articulated linkage to effect this break-down or collapse.

A lever 218 is clamped to and secured to the link 196 and a mechanical displacement means, generally indicated at 220 is provided to engage the lever 218 and displace the articulated linkage from its overcenter position. When so displaced, input movement of the lever 186 against the link 196 merely serves to collapse and articulate the linkage against the restraint of the spring 208, and since the spring 212 applies a substantially greater force than the spring 208, the respective gear carriage remains with its transfer gear parked in the rack 132.

Figure 7:
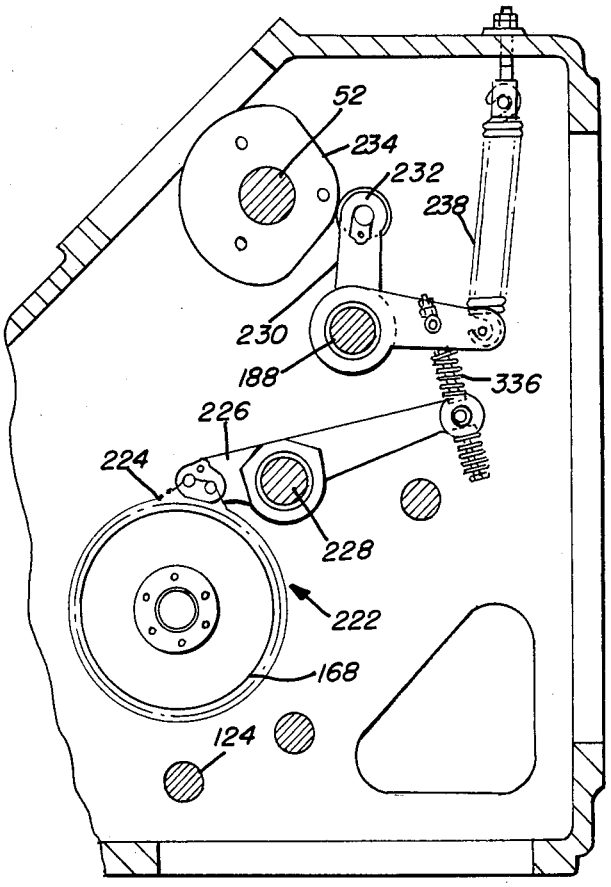
FIG. 7 is a cross sectional view taken substantially along line 7—7 of FIG. 3.

A respective band brake generally indicated at 222 in FIG. 7 preferably is provided for each of the flywheel 168, and ring gears 138, 140 to positively clamp these members when the respective transfer gear is in the non-use position so as to ensure proper tooth alignment and to avoid unneccessary noise and wear of the epicyclic gearing assemblies when engagement occurs. The brake may comprise a band 224 encircling the flywheel 168, and the gear rings 138, 140 respectively, the band being connected to a pivotably mounted lever 226 oscillated about a fixed shaft 228 by means of a lever 230 pivotably mounted about the shaft 188, the lever having a cam follower 232 driven by a cam 234 fastened to the shaft 52. The lever 230 acts on the lever 226 against the restraint of the spring 236, while the lever 230 is biased against the cam by means of a spring 238. The action is such that during each cycle when the respective gear carriage is in the parked position the epicyclic gearing members are positively stopped from rotating.

The mechanical displacement means 220 comprises a pattern chain 240 trained about a pair of spaced sprockets 242, 244, the sprocket 242 being mounted on the driven shaft 72 while the sprocket 244 is an idle sprocket journalled on a stud shaft 246. The chain 240 has individual links, certain of which carry rollers 248 at intervals thereon determined by the patterning requirements of the indexing apparatus. Since the sprocket drive shaft 72 is driven in timed relationship with the tufting machine, so to are the rollers. The rollers are positioned relative to the lever 218 so that when a roller is present, the lever 218 will be pivoted from the position illustrated in FIG. 4 in a counter-clockwise direction to move the link 196 of the articulated linkage and thus move the articulated linkage from its overcentered position resulting in no motion being transferred by the linkage to the effected gear carriage. If a roller is not present during a particular cycle, the articulated linkage will remain in its overcenter position and act to move the gear carriage when the lever 186 is pivoted by the cam 184 in the driving direction. When a roller 248 acts to pivot the lever 218 so that the articulated linkage collapses, the angle between the links 196 and 204 will be increased by the action of the cam driven lever 186, but no transfer of force or movement will be imparted through the linkage to the respective gear carriage. Of course, when the linkage is extended to its overcenter position the force transmitted to the respective gear carriage will result in the transfer gear carried thereby to be moved into meshing engagement with the corresponding gear sector to be moved thereby.

Although other patterning means to apply a mechanical displacement or the like to the gear carriages may be utilized, the means 220 of the present invention is highly desirable since programming changes may be made merely by relocating the position of the rollers 248 about the chain, and such changes can be readily made by those having ordinary skill, thereby removing the necessity of electronically skilled programers. Any particular step-wise shift of the needle bar, or change in rotation of a backing material feed roll, within the confines of the range of increments provided by the gear ratios of the epicyclic gear assemblies, may be selected by positioning the rollers 248 of each of the three pattern chains associated with the respective gear carriages and transfer gears may be readily made to provide the selected increment for each cycle. If no incremental change is to be made, all three pattern chains will have a roller engage its respective lever 218 so that none of the three illustrated transfer gears will receive movement from the corresponding gear sector.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a reciprocating needle bar and a feed roller for feeding a backing material for penetration by needles carried by said needle bar, indexing apparatus for incrementally stepping at least one of said needle bar laterally and said feed roller rotationally in accordance with a pattern, said apparatus comprising a plurality of drive input means rotatably oscillated in timed relationship with said needle bar, a drive output means operatively connected to said at least one of said needle bar and feed roller, a respective selectively engagable drive transmission means-disposed intermediate each drive input means and said drive output means, and programmable selection means for each drive transmission means for periodically in timed relationship with said needle bar selectively coupling the corresponding drive transmission means with the respective drive input means to provide a controlled rotary input to the respective drive transission means in timed relationship with said needle bar, a first of said drive transmission means having a rotatable output member operatively connected to said drive output means and an input member operatively connected to said output member, the other of said drive transmission means each having an input member operatively connected to said output member, such that said controlled input to the respective drive transmission means is collectively applied to said output member and rotatably drive said output member and thereby said drive output means in accordance with the rotational summation of the selected inputs.

2. In a tufting machine as recited in claim 1, wherein each of said drive transmission means includes a transfer member coupled to a respective input member and selectively moveable into and out of coupling engagement with a respective drive input means, and each of said selection means including actuator means for selectively moving the respective transfer member into coupling engagement with said respective drive input means.

3. In a tufting machine as recited in claim 2, wherein each actuator means comprises cyclicly driven linkage operatively connected to a respective transfer member, said linkage being selectively collapsible from a force applying disposition with said respective transfer member to move the transfer member into coupling engagement with the respective drive input means to a non-force applying disposition, and pattern means for collapsing said linkage selectively to interrupt the application of force to said transfer member in accordance with a pattern.

4. In a tufting machine as recited in claim 3, wherein said linkage is connected to and driven by a pivotably mounted lever, cam means for pivotally driving said lever in timed relationship to said needle bar, and biasing means for urging said linkage to said force applying disposition.

5. In a tufting machine as recited in claim 4, wherein said pattern means comprises a continuous chain having contact members selectively disposed thereon in accordance with a pattern, and means carried by said linkage and disposed for engagment with said contact members to overcome the urging of said biasing means to collapse said linkage when engaged by a contact member.

6. In a tufting machine as recited in claim 5, wherein said chain comprises a multiplicity of links, and said contact members comprise rollers disposed thereon.

7. In a tufting machine as recited in claim 1, wherein said first drive transmission means comprises a first epicyclic gear assembly having a sun gear, a ring gear having internally disposed gear teeth and a plurality of planet gears disposed intermediate and in meshing relationship with said sun gear and said ring gear, said output member being operatively connected to said sun gear, a second of said drive transmission means comprising a second epicyclic gear assembly having a sun gear, a ring gear having internally disposed gear teeth and a plurality of planet gears disposed intermediate and in meshing relationship with the sun gear and ring gear of said second asssembly, said first and second assemblies having a common planet cage for carrying a plurality of planet pins, and a planet gear of each assembly being rotatably mounted on each of said pins.

8. A tufting machine as recited in claim 7, wherein said input member of said first of said drive transmission means comprises the ring gear of said first epicyclic gear assembly, said input member of a second drive transmission means comprising the ring gear of said second epicyclic gear assembly, and said input member of a third drive transmission means comprising a driven member operatively connected to the sun gear of said second epicyclic gear assembly.

9. In a tufting machine as recited in claim 2, wherein each drive input means comprises at least a sector of a gear, and each transfer member comprises a transfer gear adapted for meshing engagement with the respective sector for transferring the motion thereof to the respective input member.

10. In a tufting machine as recited in claim 9, wherein each drive transmission means comprises a transfer gear carriage carrying a respective transfer gear, means for mounting each transfer gear for rotation relatively to the respective transfer gear carriage, means for pivotably mounting each carriage for movement toward and away from a respective sector for positioning the transfer gear in meshing engagement with a respective sector when the carriage is pivotably moved toward that sector.

11. In a tufting machine as recited in claim 10, wherein each actuator means comprises cyclicly driven linkage operatively connected to a respective carriage, said linkage being selectively collapsible from a force applying disposition with said respective carriage to move the transfer gear into meshing engagement with the respective sector to a non-force applying disposition, and pattern means for collapsing said linkage selectively to interupt the application of force to said carriage in accordance with a pattern.

12. In a tufting machine as recited in claim 11, wherein said linkage is connected to and driven by a pivotably mounted lever, cam means for pivotally driving said lever in timed relationship to said needle bar, and biasing means for urging said linkage to said force applying disposition.

13. In a tufting machine as recited in claim 12, wherein said pattern means comprises a continuous chain having contact members selectively disposed thereon in accordance with a pattern, and means carried by said linkage and disposed for engagment with said contact members to overcome the urging of said biasing means to collapse said linkage when engaged by a contact member.

14. In a tufting machine as recited in claim 13, wherein said chain comprises a multiplicity of links, and said contact members comprise rollers disposed thereon.

15. In a tufting machine as recited in claim 8, wherein each of said drive transmission means includes a transfer member, the transfer member of said first drive transmission means being coupled to said ring gear of said first epicyclic gear assembly and selectively moveable into and out of coupling engagement with a first drive input means, the transfer member of said second drive transfer means being coupled to said ring gear of said second epicyclic gear assembly and selectively moveable into and out of coupling engagement with a second drive input means, and the transfer member of said third drive transmission means being coupled to said drive member and selectively moveable into and out of coupling engagement with a third drive input means, and each of said selection means including actuator means for selectively moving the respective transfer member into coupling engagement with a respective drive input means.

16. In a tufting machine as recited in claim 15, wherein each drive input means comprises at least a sector of a gear, and each transfer member comprises a transfer gear adapted for meshing engagement with the respective sector for transferring the motion thereof to the respective input member.

17. In a tufting machine as recited in claim 16, wherein each drive transmission means comprises a transfer gear carriage carrying a respective transfer gear, means for mounting each transfer gear for rotation relatively to the respective transfer gear carriage, means for pivotably mounting each carriage for movement toward and away from a respective sector for positioning the transfer gear in meshing engagement with a respective sector when the respective carriage is pivotably moved toward that sector.

18. In a tufting machine as recited in claim 17, wherein each actuator means comprises cyclicly driven linkage operatively connected to a respective carriage, said linkage being selectively collapsible from a force applying disposition with said respective carriage to move the transfer gear into meshing engagement with the respective sector to a non-force applying disposition, and pattern means for collapsing said linkage selectively to interupt the application of force to said carriage in accordance with a pattern.

19. In a tufting machine as recited in claim 18, wherein said linkage is connected to and driven by a pivotably mounted lever, cam means for pivotally driving said lever in timed relationship to said needle bar, and biasing means for urging said linkage to said force applying disposition.

20. In a tufting machine as recited in claim 19, wherein said pattern means comprises a continuous chain having contact members selectively disposed thereon in accordance with a pattern, and means carried by said linkage and disposed for engagment with said contact members to overcome the urging of said biasing means to collapse said linkage when engaged by a contact member.

21. In a tufting machine as recited in claim 20, wherein said chain comprises a multiplicity of links, and said contact members comprise rollers disposed thereon.

22. In a tufting machine having a reciprocating needle bar and a feed roller for feeding a backing material for penetration by needles carried by said needle bar, indexing apparatus for incrementally stepping at least one said needle bar laterally in said feed roller rotationally in accordance with a pattern, said apparatus comprising a drive input means driven in timed relationship with said needle bar, a drive output means operatively connected to said at least one of said needle bar and feed roller, drive transmission means disposed intermediate said drive input means and said drive output means, and mechanically programmable selection means for providing a signal to said drive transmission means for coupling the drive transmission means with the drive input means and the drive output means, said selection means comprising linkage operatively connected to said transmission means and to a cyclicly driven member, said linkage having a force applying disposition with said transmission means wherein said drive transmission means couples said drive input means and said drive output means and a non-force applying disposition wherein coupling does not occur, biasing means for urging said linkage into one of said force applying and non-force applying dispositions, pattern means comprising a continuous chain having contact members selectively disposed thereon in accordance with a pattern, and engagement means carried by said linkage and disposed for engagement with said contact members to overcome the urging of said biasing means when engaged by a contact member.

* * * * *